US005246559A

United States Patent [19]

Bishara et al.

[11] Patent Number: 5,246,559

[45] Date of Patent: Sep. 21, 1993

[54] ELECTROLYTIC CELL APPARATUS

[75] Inventors: Jeries I. Bishara, Mentor; James R. Brannan, Perry, both of Ohio

[73] Assignee: ELTECH Systems Corporation, Boca Raton, Fla.

[21] Appl. No.: 799,653

[22] Filed: Nov. 29, 1991

[51] Int. Cl.[5] ..... C25B 9/00; C25B 13/08; C25C 7/00

[52] U.S. Cl. ..... 204/232; 204/252; 204/263; 204/290 F; 204/DIG. 13; 204/296

[58] Field of Search ..... 204/252-258, 204/263-266, 296, 290 F, 232, DIG. 13

[56] References Cited

U.S. PATENT DOCUMENTS

| | | | |
|---|---|---|---|
| 3,928,146 | 12/1975 | Russell | 204/232 X |
| 4,302,304 | 11/1981 | Ueda et al. | 204/130 |
| 4,853,101 | 8/1989 | Hruska et al. | 204/296 |
| 5,006,216 | 4/1991 | Dietrich et al. | 204/257 |
| 5,092,977 | 3/1992 | Bachot et al. | 204/296 X |

FOREIGN PATENT DOCUMENTS

WO86/01841 3/1986 PCT Int'l Appl. .

*Primary Examiner*—Donald R. Valentine
*Attorney, Agent, or Firm*—John J. Freer

[57] ABSTRACT

A method, and apparatus therefor, for the electrolytic treatment of an acidic solution which comprises: (a) providing an electrolytic cell, the cell comprising: (i) an anode chamber and an anode therein; (ii) a cathode chamber and a cathode therein; (iii) a diaphragm of a non-isotropic fibrous mat comprising 5-70 weight percent organic halocarbon polymer fiber in adherent combination with about 30-95 weight percent of finely divided inorganic particulate impacted into said fiber during fiber formation, the diaphragm having a weight per unit of surface area of about 3-12 kilograms per square meter; (b) introducing the acidic solution into the cell; (c) applying a DC voltage between the anode and the cathode causing the migration of ions through the diaphragm; and (d) recovering a product of the electrolytic treatment from the anode chamber, or the cathode chamber, or from both chambers. The method, and apparatus therefor, are particularly applicable to the recovery of hexavalent chromium from a dilute chromium electroplating rinse solution.

12 Claims, 1 Drawing Sheet

ELECTROLYTIC CELL APPARATUS

BACKGROUND OF THE INVENTION

1. Technical Field

The present invention relates to the electrolytic treatment of an acid solution, for instance the recovery of metals from an acid solution. One example of the present invention is the preparation of a more concentrated solution containing hexavalent chromium from a dilute electroplating rinse solution containing hexavalent chromium.

2. Description of the Prior Art

In the electroplating of a workpiece in a chromic acid solution, the electroplating cell is generally followed by one or more rinse tanks in which the plated workpiece is rinsed. It is desirable to maintain a low concentration of chromium ions in the rinse water. Accordingly, where more than one rinse tank is used, fresh water can be introduced into the last rinse tank, and cascaded from the last rinse tank to the penultimate rinse tank, on up to the rinse tank closest to the electroplating cell. The rinse tank closest to the electroplating cell experiences a build-up of chromium ions in the tank. The rinse solution in this rinse tank has too high a concentration of chromium ions for sewer disposal of the solution In addition, it is economically desirable to recover the chromium ions if possible.

U.S. Pat. No. 4,302,304 discloses a process for treating a chromic acid-containing metal plating waste water. The metal plating waste water is fed to the cathode chamber of an electrolytic cell. The cell is partitioned with a diaphragm. A DC voltage is applied between the cell anode and the cathode. This causes the migration of chromate or dichromate ions to the anode chamber. Chromic acid is recovered in the anode chamber of the cell, and reusable water is recovered in the cathode chamber of the cell. The diaphragm may be made of glass fiber, porcelain, cloth, or of porous high molecular weight polymers. The chromic acid withdrawn from the anode chamber is sufficiently concentrated that it can also be reused.

SUMMARY OF THE INVENTION

The present invention resides broadly in an electrolytic cell for treating an acidic solution. The cell comprises an anode chamber and an anode therein, a cathode chamber and a cathode therein, and a diaphragm of a non-isotropic fibrous mat comprising 5–70 weight percent organic halocarbon polymer fiber in adherent combination with about 30–95 weight percent of finely divided inorganic particulate impacted into said fiber during fiber formation. The diaphragm has a weight per unit surface area of about 3–12 kilograms per square meter, and a permeability of less than 0.03 $mm^{-1}Hg$ at two liters per minute air flow through a 30 inch square area of the diaphragm. The cell comprises means for recovering an electrolytic treatment product from the anode chamber, the cathode chamber, or from both chambers.

Preferably, the diaphragm has a permeability of less than 0.015 $mm^{-1}Hg$ at two liters per minute air flow through a 30 inch square area of the diaphragm.

The present invention also resides in a method for the electrolytic treatment of an acidic solution comprising the steps of (a) providing an electrolytic cell, said cell comprising an anode chamber and an anode therein, a cathode chamber and a cathode therein, and a diaphragm of a non-isotropic fibrous mat comprising 5–70 weight percent organic halocarbon polymer fiber in adherent combination with about 30–95 weight percent of finely divided inorganic particulate impacted into said fiber during fiber formation, said diaphragm having a weight per unit of surface area of about 3–12 kilograms per square meter; (b) introducing said acidic solution into said cell; (c) applying a DC voltage between said anode and said cathode causing the migration of ions through said diaphragm; and (d) recovering a product of said electrolytic treatment from said anode chamber, from said cathode chamber, or from both chambers.

Preferably, the diaphragm has a permeability of less than 0.03 $mm^{-1}Hg$ at two liters per minute air flow through a 30 inch square area of the diaphragm, more preferably in the range of 0.015–0.01 $mm^{-1}Hg$ at two liters per minute air flow through a 30 inch square area of the diaphragm.

An embodiment of the present invention resides in a chromium electroplating apparatus which comprises an electroplating cell, and at least one rinse tank for said electroplating cell. The rinse tank contains a relatively dilute solution of chromic acid. An electrolytic cell is also provided. The electrolytic cell comprises an anode chamber and an anode therein, a cathode chamber and a cathode therein, and a diaphragm separating the cathode chamber from the anode chamber. Means are provided communicating the rinse tank with the electrolytic cell cathode chamber. The diaphragm comprises a non-isotropic fibrous mat comprising 5–70 weight percent organic halocarbon polymer fiber in adherent combination with about 30–95 weight percent of finely divided inorganic particulate impacted into said fiber during fiber formation. The diaphragm has a weight per unit surface area of about 3–12 kilograms per square meter, and a permeability of less than 0.03 $mm^{-1}Hg$ at two liters per minute air flow through a 30 inch square area of the diaphragm.

The present invention also resides in a method for recovering chromic acid from a chromium electroplating rinse solution which comprises providing said chromium electroplating apparatus; introducing a rinse solution into the cathode chamber of the electrolytic cell; applying a DC voltage between said anode and said cathode causing the migration of chromate ions from said cathode chamber to said anode chamber; and recovering a more concentrated solution of chromic acid from said anode chamber for reuse in the plating process.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
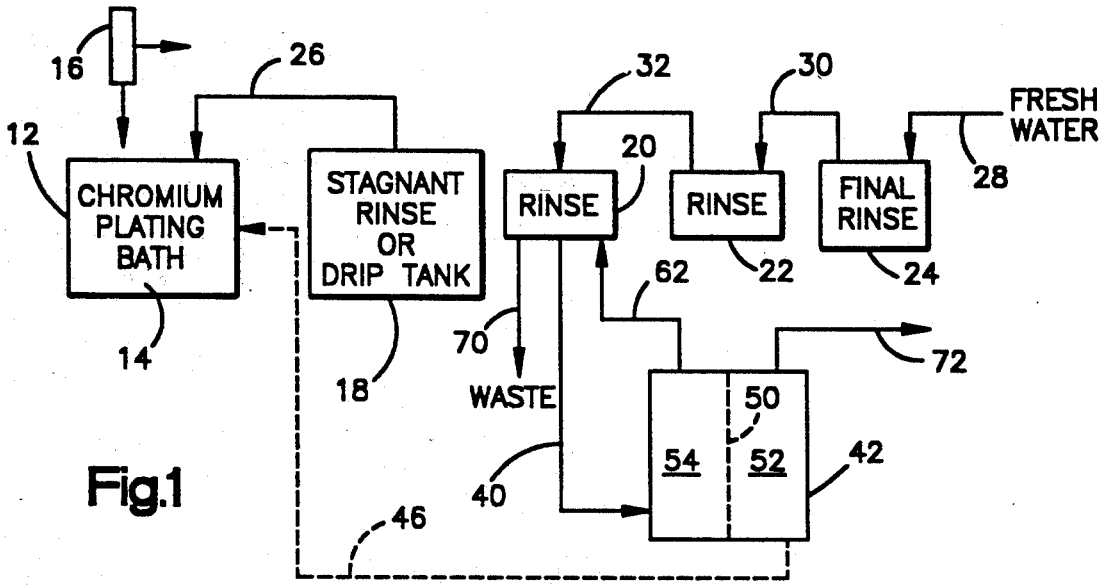
FIG. 1 is a schematic flow diagram of a chromium plating process and chromic acid recovery system in accordance with an embodiment of the present invention.

Referring to FIG. 1, an electroplating cell 12 contains a chromic acid plating bath 14. A part 16 is dipped into the bath 14, and held in the bath 14 for a sufficient period of time to be plated. After plating, the part 16 is moved to or above a stagnant tank 18. It is either held above the tank 18, in which instance the tank 18 functions as a stagnant drip tank, or it is dipped into the tank 18, in which instance the tank 18 functions as a stagnant rinse tank. Usually, the tank 18 will be referred to herein for convenience as a rinse tank. From the tank 18, the part 16 is then transported to one or more rinse tanks. In the embodiment of FIG. 1, three rinse tanks are shown, a first rinse tank 20, a second rinse tank 22, and a third rinse tank 24.

The stagnant rinse or drip tank 18 has a solution in it which may be moderately concentrated in chromate ions from solution which is carried over from the plating bath 14 by multiple parts 16. Line 26 returns the solution in tank 18 to the electroplating cell 12, as make-up for the plating bath 14. This can be carried out on a continuous basis, or periodically, for instance once a day. If necessary, the stagnant rinse or drip tank 18 can be replenished with solution drawn from the first rinse tank 20.

As the part 16 is moved from the stagnant rinse or drip tank 18 to the first rinse tank 20, and then to the second rinse tank 22 and third rinse tank 24, chromic acid is rinsed from the part 16. Most of the chromic acid is removed from the part 16 in the first rinse tank 20, with lesser amounts being removed in the second and third rinse tanks 22 and 24. Thus, the rinse tank with the highest concentration of chromate ions becomes the first rinse tank 20.

To compensate for evaporation and other losses in the rinse tanks 20, 22 and 24, fresh water is introduced into the third rinse tank 24, in line 28. The rinse solution in the third rinse tank 24 is then cascaded in line 30 to the second rinse tank 22, and from there, in line 32, to the first rinse tank 20, all at essentially the same rate at which fresh water is added to the final rinse tank 24, in line 28. In this way, the chromic acid in the rinse tanks 20, 22 and 24 is continuously diluted.

Those skilled in the art will recognize that different electroplating operations can be assembled in a large number of different ways, and that the above usage of rinse tanks and/or a drip tank 18 is disclosed herein by way of example only.

Figure 2:
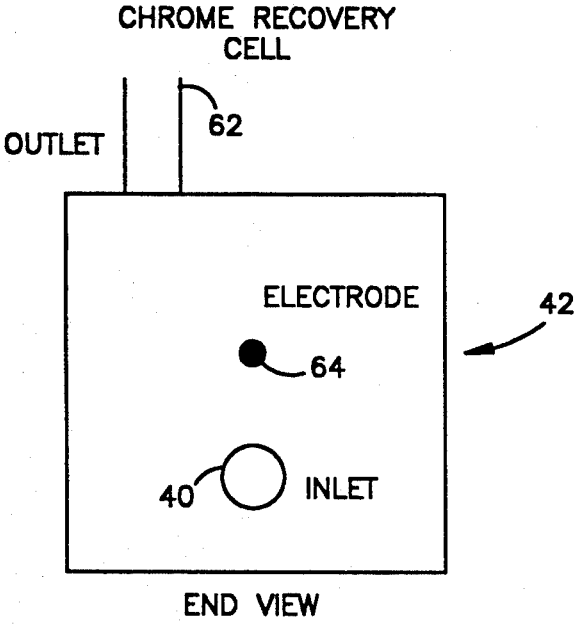
FIG. 2 is a schematic elevation, end view of an electrolytic cell of the recovery system of FIG. 1.
Figure 3:
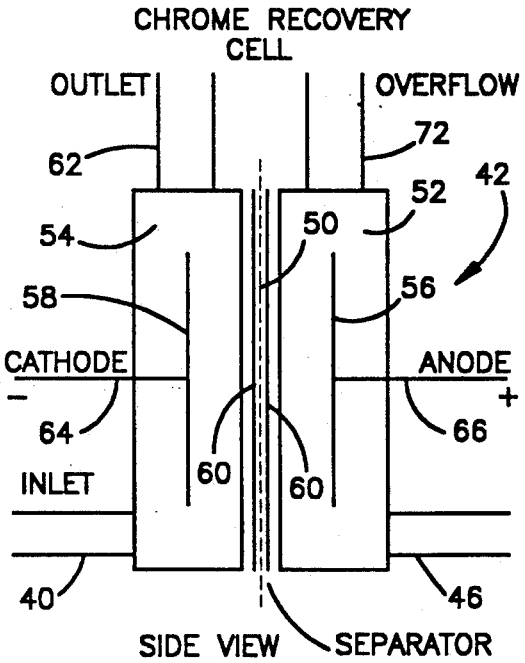
FIG. 3 is a schematic elevation, section, side view of the electrolytic cell of FIG. 2.

In accordance with the present invention, an electrolytic cell 42 is connected, by line 40, with the first rinse tank 20. The electrolytic cell is shown in FIGS. 2 and 3. The electrolytic cell is partitioned by a diaphragm 50 (FIG. 3) into a cathode chamber 54 and an anode chamber 52. The diaphragm 50 may sometimes be referred to herein as a "separator". Only one anode chamber 52 and one cathode chamber 54 are shown in FIG. 3. In a commercial apparatus, the electrolytic cell 42 may comprise multiple anode chambers 52 and multiple cathode chambers 54, separated by multiple diaphragms 50. Also, for purposes of illustration, the electrolytic cell 42 is shown in FIG. 3 with parts separated from one another. During use, the cathode chamber 54 and anode chamber 52 are positioned contiguous with each other separated by diaphragm 50 and gaskets 60, which seal the chambers 52, 54. The anode chamber 52 contains an anode 56, and the cathode chamber 54 contains a cathode 58. Line 40 (FIGS. 1 and 3) connects the first rinse tank 20 with the cathode chamber 54, as shown in FIGS. 1 and 3. A return line 62, FIGS. 1, 2 and 3, leads from the cathode chamber 54 back to the rinse tank 20.

As an alternative, the return line 62 could lead back to the final rinse tank 24, or to the second rinse tank 22.

In operation, the metal plating rinse solution, from the rinse tank 20 (FIG. 1) flows in line 40 to the cathode chamber 54 (FIG. 3) of the electrolytic cell 42. The flow in line 40 is a relatively concentrated solution containing chromate ions. A voltage is impressed on the cathode and anode of the electrolytic cell 42 through suitable electrode connectors 64, 66. (FIGS. 2 and 3). FIG. 2 shows the location of connector 64 for cathode 58. FIG. 2 also shows lines 40 and 62. Under the influence of the impressed voltage on the anode and the cathode, chromate ions pass through the diaphragm 50 (FIG. 3) from the cathode chamber 54 to the anode chamber 52. Thus, return line 62 returns a solution to the rinse tank 20 (or to the rinse tanks 22 or 24 if desired) which has a relatively low concentration of chromate ions therein.

It will be apparent to those skilled in the art that some $Cr^{+3}$ and other metal ions will plate at the cathode 58. Most of the $Cr^{+3}$ and metal ions in the catholyte will precipitate from the solution and be filtered from the solution in a clarifier (not shown) prior to return of the solution to rinse tank 20, in a manner well known in the art.

The electrolytic cell 42 has an outlet line 46, shown as a dashed line in FIG. 1, between the anode chamber 52 of the electrolytic cell 42 and the electroplating cell 12. Operation of the electrolytic cell 42 results in the concentration of chromate ions in the anolyte of the cell, in anode chamber 52. This produces a solution in the anode chamber 52 which has a relatively high concentration of chromate ions. This relatively concentrated solution is returned in line 46 to the electroplating cell 12. Preferably, the concentrated solution is withdrawn from the electrolytic cell 42, on a periodic basis, to a receiving vessel (not shown) and then withdrawn from the receiving vessel, as needed, to the electroplating cell 12. The use of a dashed line means that the flow of anolyte back to the electroplating cell may be other than direct.

Periodically, a portion of the rinse solution in rinse tank 20 may be withdrawn in line 70, FIG. 1, for waste treatment. The purpose of line 70 is to purge from the rinse solution in vessel 20 contaminants which may build up in the rinse solution over a period of time.

It can be seen from the above that the electrolytic cell 42 accomplishes a plurality of objectives. Primarily, it accomplishes a recovery of chromate ions from the rinse solution which can be recycled to the plating bath 14. It may also remove $Cr^{+3}$ and metal impurities. In addition, the electrolytic cell 42, by providing a means for recovering the chromium, reduces or eliminates the amount of waste that has to be withdrawn in line 70 and subjected to waste treatment. This also reduces the amount of fresh rinse water that has to be added to the rinse tank 24 in line 28.

The separator 50, in the present invention, is a diaphragm. Being a diaphragm, it is possible for water, hereinafter referred to as transport water, to flow from the cathode chamber 54 to the anode chamber 52, along with the chromate ions. Line 72, FIG. 3, provides an overflow to accommodate the transport water. However, it is desirable to reduce the flow of transport water into the anode chamber, since an objective in operation of the electrolytic cell 42 is to obtain as concentrated a solution as possible of chromate ions in the anolyte.

In accordance with the present invention, the separator 50 is a dimensionally stable diaphragm disclosed in U.S. Pat. No. 4,853,101, issued Aug. 1, 1989. It is disclosed in the patent that the diaphragms are useful in a chlor-alkali cell. By the term "dimensionally stable", it is meant that the diaphragm 50 is resistant to corrosion or swelling from the environment of the solutions within the cell 42. Broadly, the diaphragm comprises a non-isotropic fibrous mat wherein the fibers of the mat comprise 5–70 weight percent organic halocarbon polymer fiber in adherent combination with about 30–95 weight percent of finely divided inorganic particulates impacted into the fiber during fiber formation. The diaphragm has a weight per unit of surface area of between about 3 to about 12 kilograms per square meter. Preferably, the diaphragm has a weight in the range of about 3–6.1 kilograms per square meter.

The inorganic particulates are refractory in the sense that they retain particulate integrity under the physical conditions of composite fiber formation. The particulates are also inert to the polymer fiber substrate and to the environment of the solutions within the cell 42. By being inert, they are capable of being physically bound to the polymer in processing, without chemically reacting with the polymer, and they are not corroded by the solutions within the cell 42. A particularly preferred particulate is zirconia. Other metals and metal oxides, i.e., titania, can be used, as well as metal alloys, silicates such as magnesium silicate and alumino-silicate, aluminates, ceramics, cermets, carbon, and mixtures thereof.

The particulates preferably have a particle size of less than about 100 mesh (about 150 microns), more preferably smaller than about 400 mesh (36 microns). Preferably, the particulates have an average particle size greater than 1 micron, for ease of manufacture. Submicron particles can become substantially or virtually completely encapsulated in the polymer substrate.

In the case of zirconia, the particulate preferably has an average particle size in the range from about 1 to about 16 microns, more preferably an average particle size in the range from about 5 to about 12 microns.

The polymer precursor of the composite fibers of the present invention can be any polymer, copolymer, graft polymer or combination thereof which is chemically resistant to the chemicals within the electrolytic cell 42. A preferred polymer is a halogen-containing polymer which includes fluorine, such as polyvinyl fluoride, polyvinylidene fluoride, polytetrafluoroethylene polymer, polyperfluoroethylene propylene, polyfluoroalkoxyethylene, polychlorotrifluoroethylene, and the copolymer of chlorotrifluoroethylene and ethylene. Preferred polymers are polytetrafluoroethylene (PTFE) fluorocarbon polymers marketed by E. I. DuPont de Nemours & Co. under the trademark "TEFLON".

The composite fibers of the present invention can be prepared using dry mixtures of ingredients, or the composite fibers can be prepared in a liquid medium. By way of example, the ingredients in particulate form are mixed and heated to an elevated temperature effective to soften the polymer material. The mixture is then subjected to vigorous grinding and/or shearing, such as by ball milling, at that temperature. Alternatively, a shearing blender, a ribbon blender, a double-screw blender, a "BRABENDER" (trademark) mixer, a "BANBURY" (trademark) mixer, or a "HOBART" (trademark) mixer may be used. The heating should be insufficient to cause the polymer to become free-flowing, but sufficient that the polymer material will flow or become malleable in the grinding and/or shearing step. During the grinding and/or shearing, the polymer particulates are typically individually sheared and then are smeared and attenuated to a fibrillated form. The grinding and/or shearing is carried out for a period of time which is sufficient to allow the polymer fibers to grow from polymer particulates.

At the same time as the forming and growing of the polymer fibers, the inorganic particulates are firmly bound into the polymer fibers. Such binding is mechanically-induced. Some of the particulates may become encapsulated in the polymer fibers, while some are not fully encapsulated, and thus impart an inorganic, particulate character to the fiber surface. The specific character achieved is dependent upon the temperature employed during the grinding and shearing step, the proportion of inorganic particulates to polymer, and the grinding time.

Once the fibers are formed, the diaphragm 50 can be made by any method useful in the art for making diaphragms. For example, a slurry of the diaphragm-forming ingredients may be prepared and deposited on a foraminous substrate, for instance in a conventional paper-making procedure. The slurry may be drawn onto the foraminous substrate by use of a vacuum on one side of the substrate. The composite fibers which are deposited on the substrate are then removed and dried. Typically, the diaphragm formation and drying is carried out to produce a diaphragm having a thickness of about 0.03–3 centimeters, more preferably about 0.3–1.5 centimeters.

The diaphragms are then heated for a time sufficient to produce a composite structure in which the fibers are fused together. The heating should be for a time and temperature insufficient to cause any decomposition of the polymeric material. By way of example, a fiber composite using a polytetrafluoroethylene polymer, requires a fusion temperature of about 300° C. to about 390° C. Usually the heating is carried out for about 0.25–3 hours, more preferably for about 0.25–1.5 hours.

The diaphragms of the present invention preferably have a permeability of less than about 0.03 $mm^{-1}Hg$ at two liters per minute air flow through a 30 inch square area, more preferably a permeability within the range of about 0.015–0.01 $mm^{-1}Hg$ at two liters per minute air flow through a 30 inch square area. The permeability is determined by measuring the pressure required to pass air through a sheet of the material. A test apparatus is provided comprising a steel frame with a square 30 inch square opening into which has been welded a steel mesh support. The diaphragm, approximately six inches by six inches in size, is placed on the steel mesh, overlapping the steel frame. A gasket with a 30 inch square opening is placed on the diaphragm, and a steel top is bolted to the frame to seal the diaphragm in place. The top has two connectors, one connected to an air line and a flow meter, the other to a mercury (Hg) manometer. Typically, the permeability is measured with an air flow of two liters per minute through a 30 inch square piece of diaphragm and is recorded as $mm^{-1}Hg$ at two liters per minute air flow rate.

It may be necessary to compress the diaphragm manufactured by the method set forth above to achieve the desired permeability. For instance, a commercially available diaphragm, manufactured by the method set forth above, marketed by the assignee of the present application under the trademark "ELRAMIX", having a weight per unit of surface area of three kilograms per square meter required a compression of about two tons per square inch to achieve a permeability less than about 0.03, and a pressure of about 3.2 tons per square inch to achieve a permeability less than about 0.015. A commercially available "ELRAMIX" diaphragm having a weight per unit of surface area of about 3.4 kilograms per square meter compressed at one ton per square inch had a permeability of about 0.025, but required a compression of about three tons per square inch to achieve a permeability less than about 0.015. Diaphragms having a weight per unit of surface area of about 4.6 and 6.1 kilograms per square meter had permeabilities less than about 0.015 when compressed at one ton per square inch.

In general, the diaphragm compression may be within the range of from about one ton per square inch up to about six tons per square inch, or more, e.g., seven tons per square inch. However, such is more typically from about one to less than five tons per square inch. It is to bs understood that by hot pressing, the diaphragm can be serviceably compressed while accomplishing some to all of the above discussed diaphragm heating.

Further details concerning the diaphragms of the present invention are disclosed in U.S. Pat. No. 4,853,101. The disclosure cf this patent is incorporated herein by reference.

Preferably, the diaphragms of the present invention are treated with a surfactant prior to use. The treatment can be carried out in accordance with the procedure set forth in the Bon U.S. Pat. No. 4,606,805, or in accordance with the procedure set forth in the Lazarz et al. U.S. Pat. No. 4,252,878. The disclosures of both U.S. Pat. Nos. 4,606,805 and 4,252,878 are incorporated herein by reference.

A preferred surfactant is a fluorinated surface-active agent such as disclosed in U.S. Pat. No. 4,252,878. A preferred fluorinated surface-active agent is a perfluorinated hydrocarbon marketed under the trademark "ZONYL" by E. I. Dupont de Nemours & Co. One suitable perfluorinated hydrocarbon is a nonionic fluorosurfactant having perfluorinated hydrocarbon chains in its structure and the general formula $F_2C(CF_2)_mCH_2O(CH_2CH_2O)_nH$, wherein m is from 5 to 9 and n is about 11. This fluorosurfactant is available under the trademark "ZONYL FSN". This fluorosurfactant is usually supplied in liquid form at a concentration of about 20 to 50 percent solids in isopropanol or an isopropanol-water solution. Prior to use, the solution is preferably diluted with water, for instance to a concentration of about 4% V/V. The separator is then immersed in the surfactant solution and allowed to soak for a prolonged period of time, for instance about eight hours. Alternatively, the separator can be immersed under vacuum and soaked for a lesser period of time, for instance about one hour. After soaking, the separator is then dried at about 75°-80° C. for up to about eight hours, and then is ready for use.

The following Examples illustrate the present invention and advantages thereof. Examples 1-3 relate to the recovery of hexavalent chromium from a chrome plating rinse bath. Examples 4-8 are comparative Examples. Examples 9 and 10 relate to the recovery of metals other than chromium from acid baths.

EXAMPLE 1

An "ELRAMIX" (trademark) separator, having a base weight per unit of surface area of 4.2 kilograms per square meter, was pressed at five tons per inch square, and had a permeability of about 0.01. The polymer fibers were polytetrafluoroethylene. The inorganic particulate was zirconia. The separator comprised 70% zirconia and 30% polytetrafluoroethylene. The separator was fit into a test cell, such as cell 42 disclosed in FIGS. 2 and 3. FIG. 3 shows that the cathode and anode chambers 54, 52 were separable from each other. The purpose of this was to provide a cell into which different separators 50 could be inserted to test the separators. The test cell 42 had an active separator area of three inches by four inches. The cell 42 had an anode 56 which was a titanium substrate coated with a precious metal oxide, and thus was dimensionally stable. The cathode 58 was a copper mesh. The anode and cathode chambers (52, 54) were filled with a chrome plating rinse water containing 168 milligrams per liter chromium (VI) and the solution was pumped through the cathode chamber at 100 milliliters per minute. The capacity of the cathode chamber was 225 milliliters and the capacity of the anode chamber was 225 milliliters. No additions were made to the anode chamber after the chamber was filled. The cell was attached to a rectifier which was set at 50 volts. The initial current was three amps and this decreased to two amps at which amperage the current stabilized. The following Table 1 gives the data that was obtained.

TABLE 1

| Hours On Line | Amps | Catholyte Chromate Ion Concentration Initial (mg/l) | Final (mg/l) | Percent SPR |
|---|---|---|---|---|
| 0 | 3 | 168 | 168 | — |
| 8.5 | 2 | 168 | 94.5 | 44 |
| 25 | 2 | 168 | 63.5 | 62 |

The term "Initial", in Table 1, and other Tables herein, means the concentration of the chromate ions in the solution at the inlet 40 of the cathode chamber 54. The term "Final" means the concentration of the chromate ions in the solution at the outlet 62 of the cathode chamber 54. The term "Percent SPR" means percent recovery of chromate ions in a single pass through the cathode chamber. The percent is obtained by subtracting from 100 the quotient of the outlet concentration divided by the inlet concentration.

The separator 50 had a stable performance over the 25 hour duration of the test and the cell had a high, average, single pass recovery of approximately 50%. The cell experienced a very low water transport from the cathode chamber to the anode chamber through the diaphragm, less than about 0.2% based on the catholyte volume per pass.

EXAMPLE 2

The test of Example 1 was repeated using the "ELRAMIX" separator of Example 1 having a weight per unit of surface area of 4.2 kilograms per square meter pressed at three tons per inch square. This gave the separator a permeability of about 0.013. The apparatus and procedure were the same as in Example 1. The following data was obtained.

TABLE 2

| Hours On Line | Amps | Catholyte Chromate Ion Concentration Initial (mg/l) | Final (mg/l) | Percent SPR |
|---|---|---|---|---|
| 0 | 3 | 168 | — | — |
| 0.5 | 2 | 168 | 99 | 41 |
| 7 | 2.5 | 168 | 89 | 47 |

The test was terminated at 7 hours as the separator showed no signs of deterioration, and it was expected that good results would continue to be obtained, as in the test of Example 1. As in Example 1, the cell experienced a very low water transport from the cathode chamber to the anode chamber through the diaphragm, less than about 0.8% based on the catholyte volume per pass.

EXAMPLE 3

The test of Example 1 was repeated using an "ELRAMIX" separator having a weight per unit of surface area of about 5.25 kilograms per square meter. The materials of the separator were the same as in Example 1. The separator was pressed at 6.5 tons per square inch and had a permeability of less than 0.015 $mm^{-1}Hg$. The separator was wetted with a 40% V/V solution of "ZONYL FSN". The separator was fitted into a test cell, such as cell 42, which was then operated as in Example 1. The separator had an active area of three inches by four inches. The following data was obtained.

TABLE 3

| Hour On Line | Amps | Catholyte Chromate Ion Concentration Initial (mg/l) | Final (mg/l) | Percent SPR |
|---|---|---|---|---|
| 0 | 3.0 | 192 | 192 | — |
| .5 | 3.2 | 192 | 42 | 78.1 |
| 2.0 | 3.5 | 192 | 28 | 85.4 |
| 5.0 | 3.5 | 192 | 32 | 83.3 |

It can be seen from the above data that the cell had a very high single pass recovery (Percent "SPR") averaging above about 80. The cell experienced a very low water transport from the cathode chamber to the anode chamber, about 0.3% based on the catholyte volume per pass.

EXAMPLE 4

Comparative

A test was conducted as in Example 1, but using an "AMV SELEMION" (trademark Asahi Glass) anion exchange membrane as a separator, and thus not being representative of the present invention. This separator is marketed as one exhibiting excellent durability when exposed to a broad variety of chemicals. The test was conducted in the same manner as in Example 1 but with an initial anolyte concentration of one gram per liter chromic acid and an initial cell voltage of 40 volts. The following data was obtained.

TABLE 4

| Hours On Line | Amps | Catholyte Chromate Ion Concentration Initial (mg/l) | Final (mg/l) | Percent SPR |
|---|---|---|---|---|
| 0 | 7 | 200 | — | — |

TABLE 4-continued

| Hours On Line | Amps | Catholyte Chromate Ion Concentration Initial (mg/l) | Final (mg/l) | Percent SPR |
|---|---|---|---|---|
| 2 | 7 | 200 | 16 | 92 |
| 7 | 7 | 200 | 24 | 88 |
| 12 | — | — | — | — |

The "AMV" membrane had a lower electrical resistance than the "ELRAMIX" separator and it operated at a lower cell voltage with a higher current. The recovery efficiency was thus higher than observed with "ELRAMIX". However, the membrane only operated for 12 hours before chemical attack caused it to rupture and the test was terminated.

EXAMPLE 5

Comparative

The test of Example 4 was repeated using a "TOSFLEX" (trademark, Tosoh Corporation) fluorinated anionic membrane, IE-SA485. This membrane is said to be resistant to strong acids, and suitable for such applications as ion exchange, conversion of the valence of a metal ion, and recovery of acids. The same 200 milligrams per liter chromium (VI) solution was used for both the anolyte and catholyte chambers and the cell voltage was 50 volts. The following data was obtained.

TABLE 5

| Hours On Line | Amps | Catholyte Chromate Ion Concentration Initial (mg/l) | Final (mg/l) | Percent SPR |
|---|---|---|---|---|
| 0 | 1.5 | 200 | — | — |
| 1 | 1.5 | 200 | 45 | 77 |
| 2.5 | 0.1 | 200 | 176 | 12 |
| 3.5 | <0.1 | 200 | 182 | 9 |

The chromic acid in the solution quickly attacked the membrane, destroyed the ion exchange groups, and made the separator non-conductive.

EXAMPLE 6

Comparative

A "POREX" (trademark, Porex Technologies) separator made of porous polyvinylidene fluoride (fine pore) was wetted out using the "ZONYL FSN" (trademark) surfactant and was installed in the test cell of Example 5. Both the anolyte and the catholyte were the same solution as in Example 5. The cell voltage was 50 volts. The following data was obtained.

TABLE 6

| Hours On Line | Amps | Catholyte Chromate Ion Concentration Initial (mg/l) | Final (mg/l) | Percent SPR |
|---|---|---|---|---|
| 0 | 3 | 165 | — | — |
| 1 | 3.5 | 165 | 86 | 48 |
| 3.5 | 5.5 | 165 | 144 | 13 |
| 6 | 5.5 | 165 | 136 | 18 |

While the initial recovery was comparable to that achieved with the "ELRAMIX" separators of Examples 1-3, the recovery deteriorated rapidly and stabilized at a very low rate of recovery.

EXAMPLE 7

Comparative

The separator used in this test was a ceramic porous plate with the material designation P1/2B-C, marketed by Coors Ceramicon Designs, Ltd., Golden, Colo. The piece was cut to six inches by six inches, and had a thickness of about 6 millimeters. The piece had an apparent porosity of 38.5% and a pore diameter of less than 0.5 micron. The piece was fitted to the cell. The anolyte and catholyte were again the same solution but differed in concentration from the solutions in the above tests of Examples 1-6. The cell voltage was 50 volts. The following data was obtained.

TABLE 7

| Hours On Line | Amps | Catholyte Chromate Ion Concentration Initial (mg/l) | Final (mg/l) | Percent SPR |
|---|---|---|---|---|
| 0 | 1.5 | 260 | — | — |
| 2 | 5 | 260 | 260 | 0 |
| 4 | 5 | 260 | 220 | 15 |

This material had a very low recovery rate and the test was terminated after four hours.

EXAMPLE 8

Comparative

A ceramic material, sold by Hard Chrome Consultants of Cleveland, Ohio was used in the electrolytic cell of Example 1. This ceramic material typically is used for such applications as electrolytic purification of chromium plating baths. A piece of the ceramic was cut, as with the Coors material, and installed into the test cell. The piece of ceramic material was also 0.25 inch thick. The anolyte and catholyte were the same as in Example 6 and the cell voltage was 50 volts. The following results were obtained.

TABLE 8

| Hours On Line | Amps | Catholyte Chromate Ion Concentration Initial (mg/l) | Final (mg/l) | Percent SPR |
|---|---|---|---|---|
| 0 | 1 | 260 | — | — |
| 2 | 3.8 | 260 | 70 | 73 |
| 4 | 3.5 | 260 | 75 | 71 |
| 7.58 | 3.1 | 260 | 75 | 71 |

This separator had good chromic acid recovery, but the anolyte level decreased continuously due to the flow of transport water from the anode chamber to the cathode chamber. It thus became necessary to add water to maintain the anolyte level to prevent the chromic acid in the anolyte from crystallizing.

The anionic membranes of Examples 4 and 5 had good initial recovery values but were not stable in the chromic acid solution, and either ruptured, as in the case of "SELEMION" membrane, or became non-conductive, as in the case of "TOSFLEX" membrane. The membranes were also difficult to use because they should be pre-wet and must be kept wet at all times. They are also sensitive to tearing.

Both the "POREX" and "ELRAMIX" diaphragms are porous sheet materials. They are preferably wetted out using a surfactant, but can subsequently be handled and installed in the dry state. The performance of the "POREX" diaphragm deteriorated as the anolyte concentration increased.

The ceramic materials are brittle and special equipment must be used to cut and shape them. Since they are rigid, they are difficult to fit to a cell and special handling is required. Being brittle, they are also relatively easy to break. In addition, they suffered in performance, as indicated in Examples 7 and 8.

The diaphragms of the present invention not only provided good recovery of the chromium (VI) ions, but in addition gave a long life when exposed to the corrosive action of chromic acid. In addition, there was little flow of transport water into the anode chamber with the diaphragm of the present invention, less than about 1% based on the catholyte volume per pass. It will be apparent to those skilled in the art that the diaphragm of the present invention could also be employed in recovering metal from dilute acid solutions of anodizing and chromating processes.

It should also be apparent to those skilled in the art that the present invention could be used for the purification of the plating bath, by passing the plating bath to the electrolytic cell, and then recovering and returning the chromium values, free of $Cr^{+3}$ and impurities, either directly to the electroplating cell, or by way of the stagnant rinse tank.

EXAMPLE 9

This Example relates to the recovery of nickel metal from a spent electroless nickel bath. The same two compartment cell of Example 1 was used. The cell comprised an "ELRAMIX" separator similar to that of Example 1. The separator was compressed at five tons/in$^2$ and had a permeability less than 0.030 mm$^{-1}$Hg at two liters per minute air flow through a 30 in$^2$ area of the separator. The separator was wetted with "ZONYL FSN". The anode was a titanium substrate coated with a precious metal oxide. The anode had the dimensions 4"×3"×¼". The cathode was a reticulated nickel having the dimensions 4"×3"×¼".

Both the catholyte and anolyte chambers contained the same spent nickel solution. The catholyte was recirculated. The cell was operated as follows:

| | |
|---|---|
| Operating time | 3 hours |
| Catholyte vol. | 200 cc's |
| Initial current | 5 amps |
| Final current | 5 amps |
| Initial voltage | 5.5 volts |
| Final voltage | 7 volts |
| Initial catholyte pH | 4.3 |
| Final catholyte pH | 11.1 |
| Initial nickel level in catholyte | 5.9 g/liter |
| Final nickel level in catholyte | 14.5 ppm |
| Current efficiency of nickel metal recovery | 14% |

This Example showed a significant recovery of the nickel in the catholyte.

A comparative test in a single compartment cell (with no separator) under similar conditions showed no plating of nickel at the anode.

EXAMPLE 10

This Example relates to the recovery of copper and zinc from a sulfuric acid/nitric acid etch bath. The same two compartment cell of Example 9 was used. The cell comprised an "ELRAMIX" separator which was 4"×3"×¼" thick. The separator was compressed at five tons/in$^2$ and had a permeability less than 0.030

$mm^{-1}Hg$ at two liters per minute air flow through a 30 $in^2$ area of the separator. The separator was wetted with "ZONYL FSN".

The cathode was a 4"×3"×¼" thick titanium sheet. The anode was a 4"×3"×¼" thick titanium substrate coated with a precious metal oxide.

The catholyte comprised 100 cc's of sulfuric acid having a concentration of 50 grams per liter. The anolyte comprised 350 cc's of a sulfuric acid/nitric acid etching solution. The etching solution was circulated in the anolyte chamber.

The cell was operated as follows:

| | |
|---|---|
| Anolyte/Catholyte temperature | 25° C. |
| Operating time | 1 hour |
| Cell current | 5 amps |
| Cell voltage | 4.5 volts |
| Initial copper level in anolyte | 7.23 gpl |
| Final copper level in anolyte | 6.75 gpl |
| Initial zinc level in anolyte | 1.02 gpl |
| Final zinc level in anolyte | .99 gpl |
| Current efficiency of copper/zinc recovery | 2.7% |

The copper and zinc plated at the cathode. This Example showed recovery of copper and zinc at the cathode.

From the above description of the invention, those skilled in the art will perceive improvements, changes and modifications. Such improvements, changes and modifications within the skill of the art are intended to be covered by the appended claims.

Having described the invention, the following is claimed:

1. A cell for the electrolytic recovery of product from an acidic solution containing metal in solution, said cell comprising:

(a) an anode chamber and an anode therein;

(b) a cathode chamber and a cathode therein;

(c) a diaphragm comprising a non-isotropic fibrous mat, compressed following mat formation at a pressure in the amount of at least one ton per square inch, and comprising 5–70 weight percent organic halocarbon polymer fiber in adherent combination with about 30–95 weight percent of finely divided inorganic particulate impacted into said fiber during fiber formation, said diaphragm having a weight per unit of surface area of about 3–12 kilograms per square meter, and a permeability less than 0.03 $mm^{-1}Hg$ at two liters per minute air flow through a 30 inch square area; and (d) means for recovering said product from said anode chamber, or said cathode chamber, or from both.

2. The apparatus of claim 1 wherein said diaphragm comprises a mat of fused together inorganic halocarbon polymer fibers.

3. The apparatus of claim 2 wherein said diaphragm has a permeability in the range of 0.015–0.01 $mm^{-1}Hg$ at two liters per minute air flow through a 30 inch square area.

4. The apparatus of claim 1 wherein said diaphragm contains surfactant so as to be hydrophilic.

5. The apparatus of claim 4 wherein said diaphragm contains nonionic fluorosurfactant having perfluorinated hydrocarbon chains in its structure.

6. A chromium electroplating apparatus comprising:

an electroplating cell;

at least one rinse tank for said cell, said rinse tank being adapted to contain a relatively dilute solution of chromic acid;

an electrolytic cell comprising:

(a) an anode chamber and an anode therein;

(b) a cathode chamber and a cathode therein;

(c) a diaphragm separating the cathode chamber from the anode chamber; and (d) means communicating the rinse tank with the electrolytic cell cathode chamber;

said diaphragm comprising a non-isotropic fibrous mat comprising 5–70 weight percent organic halocarbon polymer fiber in adherent combination with about 30–95 weight percent of finely divided inorganic particulate impacted into said fiber during fiber formation, said diaphragm having a weight per unit of surface area of about 3–12 kilograms per square meter, and a permeability less than 0.03 $mm^{-1}Hg$ at two liters per minute air flow through a 30 inch square area.

7. The apparatus of claim 6 wherein said diaphragm comprises a mat of fused together organic halocarbon polymer fibers compressed at a pressure in the amount of at least one ton per square inch.

8. The apparatus of claim 7 wherein said diaphragm has a permeability in the range of 0.015–0.01 $mm^{-1}Hg$ at two liters per minute air flow through a 30 inch square area.

9. The apparatus of claim 6 wherein said diaphragm contains surfactant so as to be hydrophilic.

10. The apparatus of claim 9 wherein said diaphragm contains nonionic fluorosurfactant having perfluorinated hydrocarbon chains in its structure.

11. The apparatus of claim 6 wherein said anode is dimensionally stable.

12. The apparatus of claim 11 wherein said anode is a titanium substrate coated with a precious metal oxide.

* * * * *